United States Patent [19]

Boeckmann et al.

[11] Patent Number: 4,846,585

[45] Date of Patent: Jul. 11, 1989

[54] EASY OPEN BAG STRUCTURE

[75] Inventors: Hugo Boeckmann, Arlington Heights; Donald L. Van Erden, Wildwood, both of Ill.

[73] Assignee: Minigrip, Inc., Orangeburg, N.Y.

[21] Appl. No.: 150,229

[22] Filed: Jan. 29, 1988

[51] Int. Cl.[4] ..... B65D 33/14

[52] U.S. Cl. ..... 383/5; 383/63; 383/65; 383/95

[58] Field of Search ..... 383/63, 65, 95, 97, 383/5

[56] References Cited

U.S. PATENT DOCUMENTS

| | | | |
|---|---|---|---|
| 3,226,787 | 1/1966 | Ausnit | 383/65 X |
| 3,473,589 | 10/1969 | Gotz | 383/94 X |
| 3,780,781 | 12/1973 | Uramoto | 383/65 X |
| 3,827,472 | 8/1974 | Uramoto | 383/63 X |
| 4,589,145 | 5/1986 | Van Erden et al. | 383/63 X |

*Primary Examiner*—Stephen Marcus
*Assistant Examiner*—Nova Stucker

[57] ABSTRACT

A reclosable plastic film bag and the method of making the same with the bag having opposed side walls, pressure closable separable opposed rib and groove fastener elements on confronting faces of the top for closing the bag, plastic film above the fastener elements hermetically closing the bag top, lines of tear perforation through the film to tear off the top and perforation sealing strips attached to the surface of the film preventing the passage of air through the perforations.

14 Claims, 1 Drawing Sheet

EASY OPEN BAG STRUCTURE

BACKGROUND OF THE INVENTION

The present invention relates to improvements in plastic bags and fasteners therefor, particularly to a reclosable plastic film bag with a hermetically sealing tear strip at the top which is removable for use of the bag.

In the manufacture of plastic film bags, reclosable rib and groove profile elements have been provided which permit a bag to be opened and reclosed. Where the bags are used for containing products such as foodstuffs, flaps above the rib and groove elements have been joined to hermetically seal the bag until such time when it is purchased and opened for use. To facilitate opening, parallel lines of tear perforations have been placed above the rib and groove profiles so that a strip can be torn from the top to free the flaps and permit opening the bag by pulling the rib and groove elements apart. The addition of perforations to allow tearing a strip off the top has been known in U.S. Pat. Nos. such as 3,172,443, 3,226,787, 3,473,589 and 4,589,145.

Such perforations destroy the hermetic seal of the bag and permit the passage of air. While the rib and groove elements below the perforations may be joined to close and seal the bag, these elements may inadvertently become separated during handling, storage and merchandising so that air can enter the bag via the perforation holes. Further, the rib and groove elements per se may not be sufficiently airtight. The need for airtight integrity is especially so where the contents of the bag must be protected against air, such as where a bag contains foodstuffs, and laminated films are required. The addition of such perforations creates a problem because the rib and groove elements below said perforations may not, as indicated, be sufficiently airtight, though they present the best method of tearing off the top of the bag for access to the rib and groove elements. Other means of providing tear strips have been attempted, but these are not as satisfactory as the relatively simple expedient of perforating the film of the flaps at the bag top. Such perforations can be added by perforation equipment which operates rapidly and satisfactorily.

It is accordingly an object of the present invention to provide a bag structure and method of making the structure where the bag has reclosable rib and groove elements at the top, the flaps are joined to each other so as to provide a hermetic seal, perforations are included to be able to readily tear a strip off the top and yet the perforations do not admit air so as to jeopardize the hermetic seal of the bag.

A further object of the invention is to provide an improved bag structure which provides a reopenable bag which is positively sealed up to the time that the customer or user purchases the bag and tears a strip off the top.

A further object of the invention is to provide an improved simplified bag structure which can be inexpensively made and which provides for a sealed bag which has a reopenable feature.

FEATURES OF THE INVENTION

The invention provides for a plastic film bag having confronting side walls sealed at their edges with a pressure interlocking reopenable rib and groove element extending along the top. Above the rib and groove elements are flaps which are doubled so as to be continuous and form a hermetically sealed bag. Alternately, such flaps can also be sealed together. The top can be ripped open by tearing a strip off the bag, and this is simply and economically provided for by parallel lines of perforation to provide a tear strip at the top that can be torn off the bag. In accordance with the invention, a perforation sealing means is attached to the film so that the perforations continue to perform their function of permitting a strip to be readily torn off the top but do not impair the hermetic integrity of the bag allowing it to be stored, handled and merchandised, assuring the purchaser that the contents continue to be protected and hermetically sealed. The bag in addition to providing a bag sealed up to the time that the user wishes to open it, provides a bag that is reclosable for use until the contents are fully removed.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
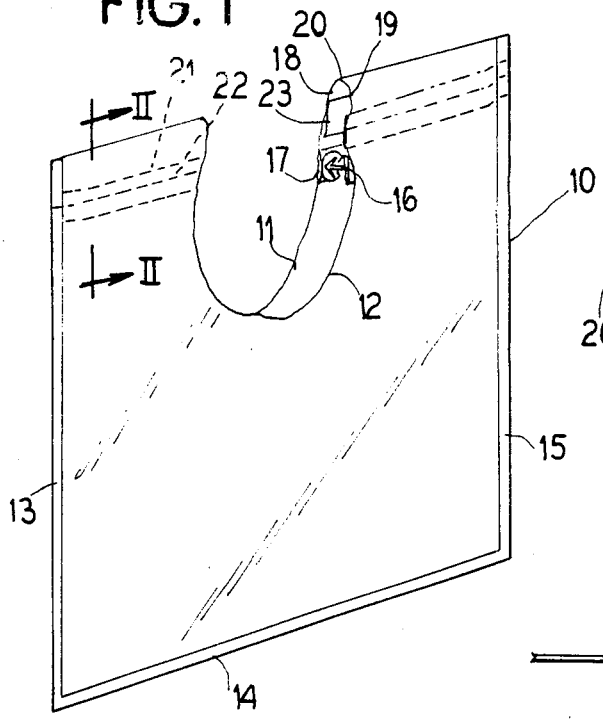
FIG. 1 is a perspective view, with portions broken away, of a bag constructed in accordance with the principles of the present invention.

FIG. 1 illustrates a formed plastic film bag of polyethylene or other plastic film with the bag shown at 10 having back and front walls 11 and 12. The walls of the bag are sealed at their edges forming side seams 13 and 15 and a bottom seam or fold 14.

Figure 2:
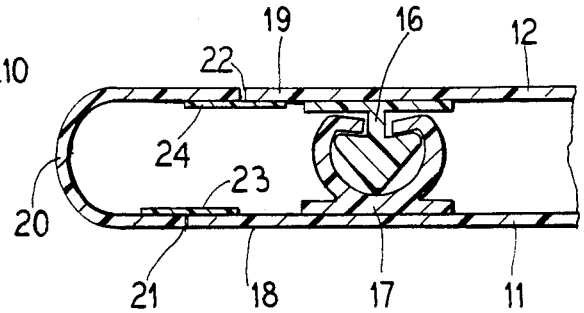
FIG. 2 is a vertical sectional view taken substantially along line II—II of FIG. 1.

Located on the confronting walls of the bag near the bag top, are shaped interlocking rib and groove profile elements with the rib shown at 16 and the groove at 17 as also illustrated in FIG. 2. The profiles may be attached to the inner surface of the film or be integral therewith. The rib and groove elements are shaped so as to be cooperative and be pressure interlocking to close the bag by applying a pressure along the profiles. The profiles can be separable for access to the contents of the bag by pulling apart flaps 18 and 19 which extend above the profiles. The flaps are shown as being integral with the side walls and for convenience, the flaps are doubled at the upper distal edge 20. By the doubling of the top, the bag is hermetically sealed until used. Alternately, the flaps could be separate and heat sealed together to create a hermetic seal. Thus, the flaps are joined to each other at the top edge of the bag, and in FIGS. 1 and 2 are joined by the plastic film being continuous or integral.

For access to the contents, a strip is torn off the top along perforated lines 21 and 22. The perforations are formed in the film so that the user may grasp the top strip between his thumb and forefinger and tear off the top. Opening flaps will remain which project above the profiles for grasping and opening the bag.

In order to provide for a removable tear strip at the top, lines of weakened tear resistance must be provided, and these are provided by the perforations 21 and 22. Advantages are attained in using perforations for the tear resistant lines in that the perforations can be easily provided by perforating tools in the manufacture of the bag, and the perforations do not substantially weaken the bag so that the top can be accidentally pulled off, but do provide a tear guideline so that the strip will separate along the predetermined line defined by the perforations when the top strip is torn off. This is particularly desirable where laminated films with strong tear resistance are used and where other means of removing a tear strip do not function satisfactorily.

For example, if no perforations are included, the hermetic integrity of the bag remains intact, but it becomes necessary to use a scissor or knife to cut off the tear strip. By placing the perforations, the tear strip is defined, but the hermetic seal afforded by the doubled top at 20 is broken.

A perforation sealing means is applied to the perforations preferably in the form shown by attaching frangible strips 23 and 24 to the inner surfaces of the film. Preferably, the strips are attached to the inner surface, but in some instances if it is desirable, the strips can be applied to the outer surfaces or both inner and outer surfaces. These frangible strips are of a lightweight material which will seal the small holes of the perforations and yet separate when the top strip is torn from the bag. While other means may be provided for sealing the perforate holes, the preferred arrangement is by the attachment of the strips 23 and 24, and these are preferably attached to the inner surface of the film. By attachment to the inner surface, they are protected so that they are not accidentally peeled off of the film surface during handling or storage, and relatively lightweight material can be used impervious to air. Further, since the attachment of the strips is protected, the strips can be attached by a light bonding adhesive so that the bonding adhesive breaks when the top strip is torn off. One form contemplated is attaching one side of the strip by a strong adhesive and the other side by a weaker adhesive so that the strip will separate from the film along one side. The weaker adhesive would preferably be placed on the side of the strip adjacent the profiles 16 and 17.

Figure 4:
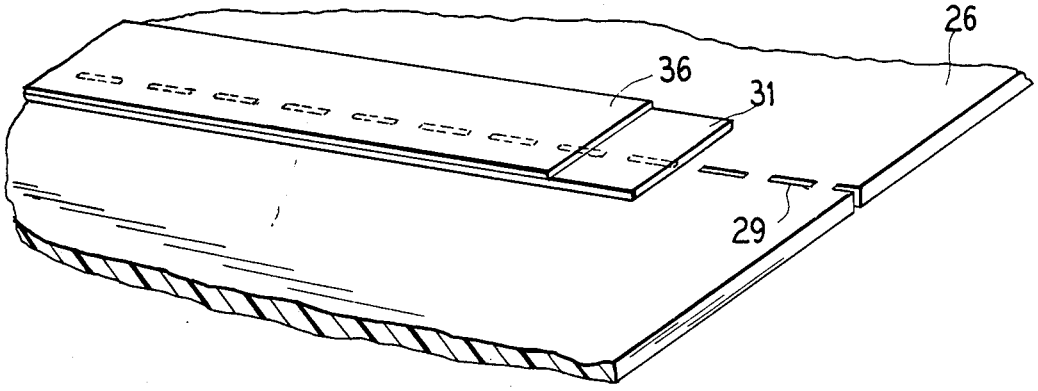
FIG. 4 is an enlarged fragmentary view of a portion of the sheet of film of FIG. 3.

The material of the strips can be thin film which provides adequate sealing of the openings or it can be of a material different than the film of the bag. By using a film considerably thinner or lighter weight than the film of the bag, effective sealing is obtained and yet the strips will tear. Or, a plastic can be used which is oriented so that it relatively easily tears laterally in the direction of the tear strip when it is pulled off. The strips 23 and 24 can be of a material which is readily frangible but which provides airtight sealing over the perforation holes. FIG. 4 shows a laminated strip having two components, one 31 for adhering the strip to the film and the other 36 for providing an air and moisture barrier such as a metal foil.

While a bag construction is shown wherein the top is integral with the walls of the bag, it will be understood that the principles of the concept may be utilized with a fastener which is secured to the top walls of a bag.

Figure 3:
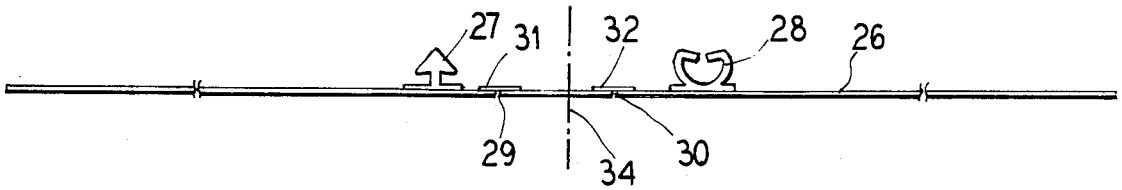
FIG. 3 is an elevational view taken from the side of a plastic sheet for forming the bag of FIG. 1.

FIGS. 3 and 4 illustrate steps of manufacture of the bag. A sheet of plastic film 26 is provided and fastener profiles 27 and 28 are attached to or integral with the upper surface of the film. Perforation lines 29 and 30 are then formed in the film with the perforation lines being parallel to and located between the profile elements 27 and 28. Sealing strips 31 and 32 are then laid over the top of the perforation holes. The sealing strips may be heat bonded to the plastic film 26 or the sealing strips 31 and 32 may be adhesive backed so that they are bonded to the surface of the film. The film is then folded about the line 34 with the ends brought together, the profiles 27 and 28 are interlocked, and the bag completed by forming the side and bottom seams shown at 13, 15 and 14 in FIG. 1. FIG. 4 illustrates the manner in which the sealing strip 31 is laid over the holes formed by the perforation line 29 in the film 26. The sealing strips may also be provided by extruding a thin layer of material over the perforations.

Figure 5:
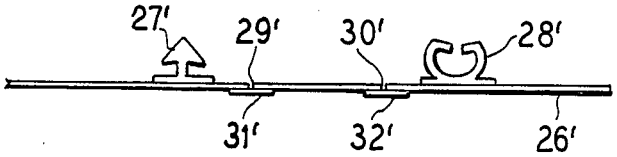
FIG. 5 is a fragmentary elevational view taken from the side of a plastic sheet for forming the bag showing a modified form.

FIG. 5 shows a modified form wherein a structure similiar to FIG. 3 is used, but the strips are placed on the outer surface of the film. A film strip 26, has profiles 27, and 28, thereon. Also, perforations 29, and 30, extending through the film. Narrow strips 31, and 32, are attached to the outer surface of the film.

In use, the plastic bag 10 is positively hermetically sealed and protected against the ingress of air since the protective sealing strips 23 and 24 prevent air from penetrating through the holes of the perforations. The strips are physically protected by the outer layers of film. When the bag is to be used, the top is torn off with the tear following the perforation lines 21 and 22, and the thin sealing strips 23 and 24 will separate along the perforation lines inasmuch as they are of a lightweight frangible material. The resultant bag will then have flaps extending above the rib and groove elements so that the bag can be opened and reclosed for reuse. The remaining torn portions of the strip provide a better flap which is easier to grip for opening the bag by pulling apart the rib and groove elements. The remaining portions of the sealing strips also slightly stiffen the flaps.

Thus, it will be seen that we have provided an improved bag structure and method of making which meets the objectives and advantages above set forth and which provide a new bag structure which can be made in an economical and expedient fashion.

We claim as our invention:

1. A reclosable plastic film bag comprising in combination:

opposed bag side walls forming a bag for containing a product;

pressure closable separable opposed rib and groove continuous plastic fastener elements at the bag top for closing the bag;

continuous plastic film extending above the rib and groove elements doubled at the distal edge of the film for hermetically sealing the bag above the rib and groove elements;

parallel lines of tear perforations in the film located between the distal edge of the film and the fastener elements permitting tearing an opening strip off the top for access to the fastener elements;

and perforation sealing frangible strips attached to a surface of the film sealing the perforations and preventing access of air therethrough and accommodating separation of the material with tearing of the film a the tear perforations.

2. A reclosable plastic film bag constructed in accordance with claim 1:

wherein said strips are formed of a material of lighter weight than the film of the bag for tearing with the film at the perforations.

3. A reclosable plastic film bag constructed in accordance with claim 1:

wherein said strips are of a material different than the material of the bag for free separation with tearing of the film along the line of tear perforation.

4. A reclosable plastic film bag constructed in accordance with claim 1:

wherein said frangible strips are attached to the inner surface of the film.

5. A reclosable plastic film bag constructed in accordance with claim 1:

wherein said frangible strips are attached to the outer surface of the film.

6. A reclosable plastic film bag constructed in accordance with claim 1:

wherein said frangible strip is formed by extrusion of a thin layer of impervious material over said perforations.

7. A reclosable plastic film bag comprising in combination:

opposed bag side walls forming a bag for containing a product;

pressure closable separable opposed rib and groove continuous plastic fastener elements at the bag top for closing the bag;

film material forming flaps extending above the rib and groove elements joined to each other at a top edge to hermetically close the bag top;

a line of tear perforation in at least one of said flaps between the top edge and the fastener elements permitting tearing and opening at the top for access to the fastener elements;

and perforation sealing means attached to the surface of the film over said line of tear perforations preventing the access of air through the perforations and accommodating separation of the material at the line of tear perforation.

8. A reclosable plastic film bag constructed in accordance with claim 7:

wherein said perforation sealing means is in the form of an air impervious strip attached to the surface of the film over the line of tear perforations.

9. A reclosable plastic film bag constructed in accordance with claim 8:

wherein said strip is separable from the surface of the film concurrent with the tearing of the line of tear perforations.

10. A reclosable plastic film bag constructed in accordance with claim 8:

wherein said strip is constructed frangible so as to be separable along the line of tear perforations concurrent with the tearing of the film along said line.

11. A reclosable plastic film bag constructed in accordance with claim 7:

wherein said perforation sealing means is attached to the inner surface of the film.

12. A reclosable plastic film bag constructed in accordance with claim 7:

including parallel lines of tear perforations in the flaps between the top edge and the fastener elements with a frangible sealing strip attached to the inner surface of the film over each of the lines of tear perforations.

13. A reclosable plastic film closure structure for a bag having opposed side walls for containing a product, the closure comprising in combination:

a doubled film strip having pressure closable separable opposed rib and groove continuous plastic fastener elements on the confronting faces of the strip for closing a bag;

lines of tear perforations in said strips between a top distal edge formed by the doubled strip and the fastener elements permitting tearing an opening strip off of the top for access to the fastener elements and the contents of the bag;

and perforations sealing means attached to the inner surface of the film preventing the access of air through the perforations and accomodating separation of the film material at the tear perforation.

14. A reclosable plastic film bag comprising in combination:

opposed bag side walls forming a bag for containing a product;

pressure closable separable opposed rib and groove continuous plastic elements at the bag top for closing the bag;

film material forming flaps extending above the rib and groove elements;

means defining a tear line extending parallel to the rib and groove elements spaced downwardly from the top edge of the flaps so that a strip may be torn off the top;

and narrow strips attached to the inner surfaces of the flaps spaced above the rib and groove elements for bridging the tear line to separate and leave a remaining stiffening portion attached to a pull flap portion of the flaps remaining above the rib and groove elements when a strip is torn off the top of the bag.

* * * * *